US006675559B1

(12) United States Patent
Hilbert, Sr. et al.

(10) Patent No.: US 6,675,559 B1
(45) Date of Patent: Jan. 13, 2004

(54) METHOD OF ROTARY HEAT SEALING ARTICLES BETWEEN WEBS

(75) Inventors: Thomas F. Hilbert, Sr., Fond du Lac, WI (US); Thomas F. Hilbert, Jr., Fond du Lac, WI (US); Dale E. Lanser, Elkhart Lake, WI (US)

(73) Assignee: Converting Biophile Laboratories, Inc., Fond du Lac, WI (US)

( * ) Notice: Subject to any disclaimer, the term of this patent is extended or adjusted under 35 U.S.C. 154(b) by 0 days.

(21) Appl. No.: 10/359,426

(22) Filed: Feb. 7, 2003

Related U.S. Application Data

(62) Division of application No. 09/942,218, filed on Aug. 30, 2001.

(51) Int. Cl.[7] ..... B65B 9/02

(52) U.S. Cl. ..... 53/450; 53/464; 53/548; 53/559; 53/562; 53/374.4; 53/389.4; 53/560; 53/553; 53/371.4

(58) Field of Search ..... 53/450, 464, 548, 53/559, 562, 374.4, 389.4, 560, 553, 371.4

(56) References Cited

U.S. PATENT DOCUMENTS

| | | | | |
|---|---|---|---|---|
| 4,171,239 A | * | 10/1979 | Hirsch et al. | 156/461 |
| 4,244,158 A | * | 1/1981 | Nelham | 53/412 |
| 4,364,787 A | * | 12/1982 | Radzins | 156/164 |
| 5,357,731 A | * | 10/1994 | Conway et al. | 53/374.4 |
| 5,656,285 A | * | 8/1997 | Sablotsky et al. | 424/448 |
| 6,115,997 A | * | 9/2000 | Burrow et al. | 53/412 |

* cited by examiner

*Primary Examiner*—Rinaldi I. Rada
*Assistant Examiner*—Brian Nash
(74) *Attorney, Agent, or Firm*—Donald Cayen

(57) ABSTRACT

A rotary heat sealing system heat seals top and bottom webs to each other around discrete articles held in predetermined alignments and spacings between the webs. The rotary heat sealing system comprises a sealing station at which the heat sealing occurs, and a tensioning station upstream of the sealing station. The tensioning station produces a tension in the top and bottom webs and the articles by wrapping them in a reverse bend so as to maintain the predetermined alignments and spacings of the articles as they enter the sealing station. The sealing station includes an anvil and a heating die with a heat sealing grid and pockets between circumferential rails. The articles enter the pockets, and the webs are sealed to each other at areas corresponding to the heat sealing grid. A force mechanism applies a predetermined force between the heating die rails and the anvil.

12 Claims, 4 Drawing Sheets

METHOD OF ROTARY HEAT SEALING ARTICLES BETWEEN WEBS

This application is a divisional of U.S. patent application Ser. No. 09/942,218 filed Aug. 30, 2001.

BACKGROUND OF THE INVENTION

1. Field of the Invention

This invention pertains to manufacturing products from flexible materials, and more particularly to apparatus that seals articles between two continuously moving webs.

2. Description of the Prior Art

It is well known to encapsulate articles inside protective wrappers. Some articles lend themselves to being captured between two sheets of wrapping material that overlie opposite sides of the article. The sheets usually have margins that project beyond the article in all directions. The sheet margins are joined to each other, thus capturing the article between them. Depending on the materials of the articles and the sheets, the sheets may be joined to each other by adhesives, heat sealing, or other means. U.S. Pat. Nos. 4,369,613; 4,720,321; and 6,182,420 show articles captured between sheets that are joined to each other by adhesives.

U.S. Pat. No. 5,441,345 shows a heat sealed pouch for a flowable product. Other equipment for packaging non-rigid articles is described in U.S. Pat. Nos. 4,598,441; 5,628,165; and 6,185,908.

Again depending on the particular article and sheet materials, the sheets may be cut from continuously moving webs. In that case, the articles are inserted at spaced intervals between the webs, and the webs are joined to each other, on a more or less continuous basis. The webs are cut at proper locations to make the final products. U.S. Pat. No. 6,115,999 teaches press rolls for sealing the longitudinal margins of continuously moving webs.

To seal webs transversely to the downstream motion of the webs and articles, it is known to employ reciprocating mechanisms. In those designs, the webs and articles advance in the downstream direction to a sealing station, where they halt momentarily. A sealing mechanism, which may be hot irons, reciprocates in directions perpendicular to the downstream direction of the webs and articles to join the webs to each other along transverse lines. Then the composite web and articles resume downstream travel until the following article is at the sealing station. Examples of reciprocating equipment that heat seals webs to each other are disclosed in U.S. Pat. Nos. 4,299,075; 4,601,157; 4,864,802; 5,803,888; and 6,115,999. U.S. Pat. No. 5,875,614 discloses a machine that uses reciprocable ultrasonic welding to join two webs to each other. The packaging machine of U.S. Pat. No. 5,044,145 uses hot air to heat the webs for joining them together. Using intermittently moving webs and reciprocating mechanisms to transversely seal webs produces undesirable vibrations. In addition, that type of sealing equipment has the disadvantages of undesirable complexity and reduced production.

To overcome the deficiencies of intermittently moving webs and reciprocating mechanisms for producing transverse seals on the webs, continuously operating rotary heat sealing equipment has been developed. In such equipment, a heating element is part of a roller that contacts a continuously moving web. The heated roller rotates and contacts the web in proper timing to the web downstream motion to produce the transverse seals. U.S. Pat. Nos. 4,244,158; 5,357,731; and 6,122,898 are representative of continuously rotating heat sealing mechanisms. U.S. Pat. No. 6,030,329 shows a rotary machine that uses ultrasonics for transversely sealing webs to each other.

Despite the availability of prior equipment for sealing webs to each other in directions transverse to the direction of web movement, a need exists for further improvements.

SUMMARY OF THE INVENTION

In accordance with the present invention, a rotary heat sealing system is provided that seals two webs to each other around articles on a continuous basis. This is accomplished by apparatus that includes a heating die having circumferential rails and a heat sealing grid that forms a nip with an anvil.

The heating die and anvil are part of a sealing station of the heat sealing system. They are geared together and rotate continuously in opposite directions. The anvil is cylindrical in shape, having a uniform diameter along its nip with the heating die heat sealing grid. The anvil is rotatably mounted on a fixed axis of rotation in side plates of a machine that completely processes the articles and webs into finished products.

The heating die is generally cylindrical in shape, having opposed axially spaced journals. The rails are close to the journals, and the heat sealing grid is between the rails. The heat sealing grid is made to suit the particular article that is sealed between the webs. In all cases, the heat sealing grid has at least two axially spaced circumferential lands and at least one transverse land connecting the circumferential lands. The lands are arranged to define pockets having a depth that suits the particular article. In a particular embodiment of the invention, there are four circumferential lands and four transverse lands that make a pattern of 12 rectangular pockets. All the circumferential and transverse lands have the same diameter relative to the axial centerline of the heating die. The diameter of the circumferential and transverse lands is slightly less than the diameter of the rails.

The heating die has a long hole along its axial centerline. A heating element is inserted into the heating die hole. The heating element has a rotary connector outside of the heating die. Applying electrical power to the heating element causes the heating die to heat.

The heating die journals are received in respective die blocks. The die blocks are slidable within the machine side plates in directions toward and away from the anvil such that the center distance between the heating die and the anvil is variable.

A force mechanism is also part of the rotary heat sealing system. The force mechanism applies a force that keeps the heating die rails in contact with the anvil. For that purpose, the force mechanism is comprised of a bearing block in each side plate of the machine. A bearing bar extends between the bearing blocks. On the bearing bar are two bearings that contact the respective heating die rails. A pressure plate is fastened to each machine side plate. A long screw is threaded through each pressure plate and bears against a corresponding bearing block. By tightening the screws, the heating die rails are kept in firm contact with the anvil by means of the force that is transmitted from the screws through the bearing blocks, bearing bar, and bearings to the heating die rails. Removing the pressure plates and bearing blocks from the machine side plates enables different heating dies to be used for making different products.

When the heating die rails are in contact with the anvil, there is a fixed clearance between the heating die heat sealing grid and the anvil. The heat sealing grid and anvil cooperate to form the nip, which has a clearance through which the webs pass. The clearance at the nip is usually equal to about the combined thicknesses of the webs. The nip defines a nip plane that is tangent to the anvil and the heating die heat sealing grid.

The articles are inserted between the webs at an insert station in the upstream direction of the rotary heat sealing system. The articles are aligned and spaced between the webs in a pattern that matches the pattern of the pockets in the heating die. The articles are held in place between the webs only by friction. The articles enter the heating die pockets as the webs and articles pass through the sealing station. As the webs and articles pass through the sealing station, the webs are sealed to each other at areas corresponding to the heat sealing grid of the heating die. The web areas at the locations of the heating die pockets remain unsealed. The result is that the articles are permanently captured in individual spaces surrounded by sealed margins of the two webs. From the rotary heat sealing system, the composite webs and articles are propelled in the downstream direction for further processing into finished products.

Further in accordance with the present invention, the rotary heat sealing system comprises a tensioning station upstream of the sealing station. The tensioning station produces a tension in the webs and articles so as to hold the articles firmly in place as they enter the sealing station. The tension is produced by wrapping the articles and webs in a reverse bend. A first bend occurs at a guide rod, which may be at the downstream end of the machine insert station. The second bend occurs at a wrap roller between the guide rod and the sealing station. The diameters of the guide rod and wrap roller are preferably different, which contributes to producing proper tension in the webs and articles. The guide rod and wrap roller are so spaced in the direction of downstream motion as to enable a person to see the alignments and spacings of the articles as they enter the sealing station. At least the guide rod is adjustable in two directions to suit different articles and webs, and also to correct any misalignment of the articles as they enter the sealing station. In a preferred embodiment, the guide rod and wrap roller have respective lowermost lines that lie in the nip plane. The webs and articles pass over the guide rod opposite its lowermost line, and then pass under the wrap roller in contact with its lowermost line.

The method and apparatus of the invention, using a heating die with a heat sealing grid in combination with a uniformly cylindrical anvil, thus seals two webs around flexible articles on a continuous basis. The probability of misaligning the articles relative to the heating die heat sealing grid is remote, even though the articles are held only by friction between the webs as the webs and articles enter the sealing station.

Other advantages, benefits, and features of the present invention will become apparent to those skilled in the art upon reading the detailed description of the invention.

DETAILED DESCRIPTION OF THE INVENTION

Although the disclosure hereof is detailed and exact to enable those skilled in the art to practice the invention, the physical embodiments herein disclosed merely exemplify the invention, which may be embodied in other specific methods. The scope of the invention is defined in the claims appended hereto.

General

Figure 1:
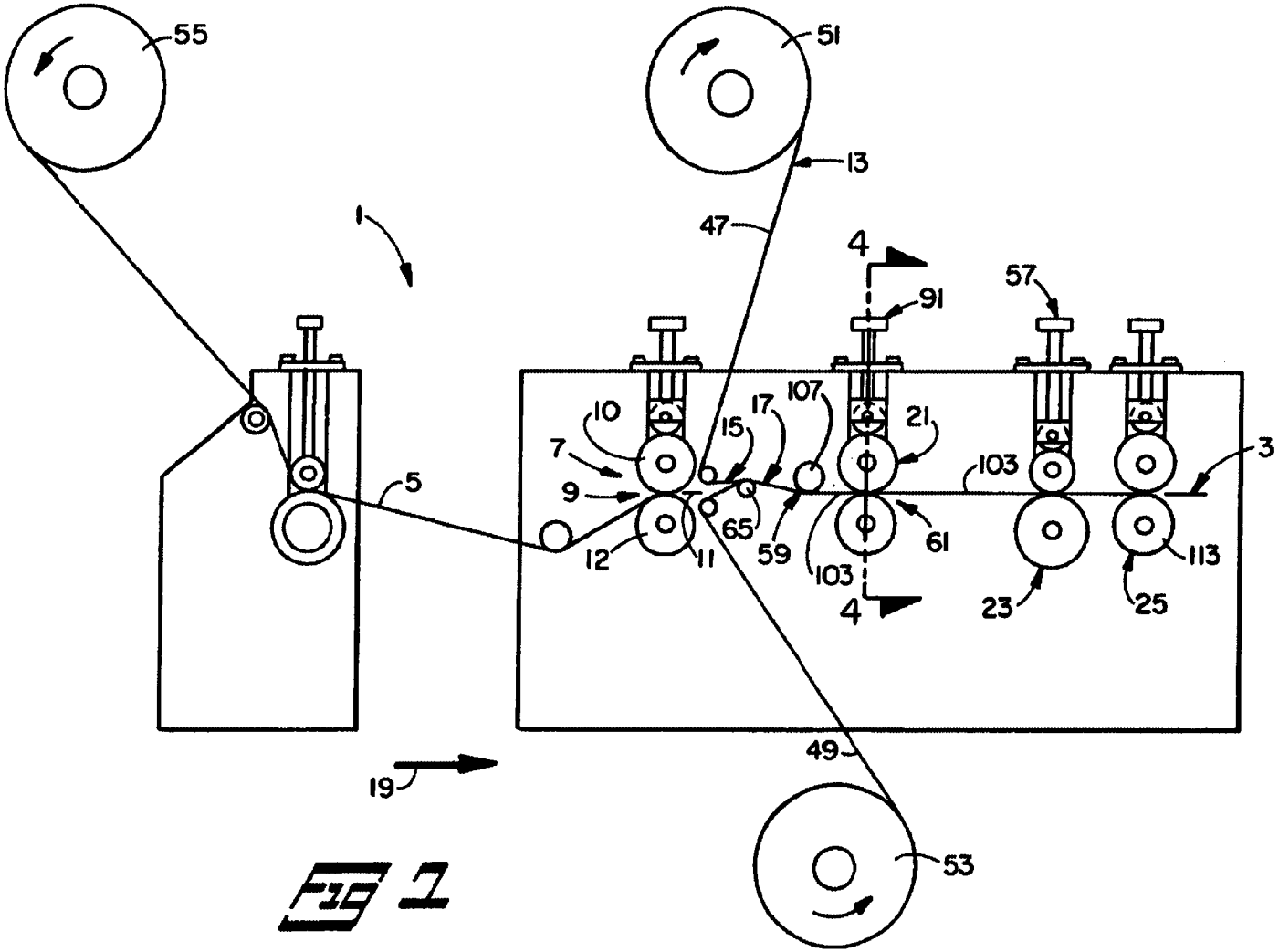
FIG. 1 is a simplified schematic view of a machine for processing webs and articles into finished products according to the present invention.
Figure 3:
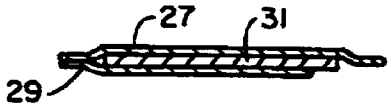
FIG. 3 is a cross-sectional view taken along line 3—3 of FIG. 2.
Figure 2:
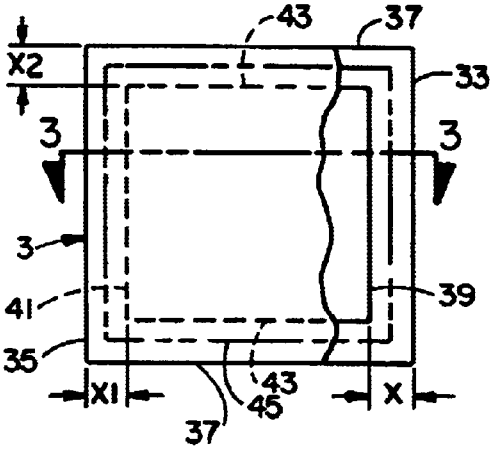
FIG. 2 is a top view of a typical product manufactured by the machine of the invention.

Referring to FIGS. 1–3, a multi-web processing machine 1 is illustrated that includes the present invention. The multi-web processing machine 1 is particularly useful for manufacturing products 3 from three different components on a continuous basis. However, it will be understood that the invention is not limited to manufacturing three-component products.

To manufacture the products 3, an infeed web 5 is drawn to a slip cutting system 7 of the multi-web processing machine 1. Preferably, the slip cutting system 7 is designed and operates according to the teachings of our copending U.S. patent application Ser. No. 09/875,525 filed Jun. 8, 2001 and titled "Slip Cutting System" and incorporated by reference herein. The slip cutting system has a cutting station 9, at which the infeed web 5 is sheeted into discrete articles 11. The discrete articles 11 are merged to a carrier web 13 at an insert station 15 of the slip cutting system, thus forming a composite web 17.

The composite web 17 is drawn in a downstream direction 19 by a drive station 23. The drive station 23 draws the composite web through the rotary heat sealing system 21 of the present invention and to a cutting station 25. At the cutting station 25, the composite web is cut into the individual products 3.

Product

The particular product 3 to be described is merely representative of a wide variety of multi-component products that are manufacturable by means of the present invention. It will be appreciated that the specific size, shape, and materials of the products can vary widely, and that the scope of the invention is not limited to manufacturing any particular product.

The particular product 3 has a flexible top sheet 27, a flexible bottom sheet 29, and a flexible pad 31. The thicknesses of the top and bottom sheets 27 and 29, respectively, and of the pad 31 need not be equal, nor need they be made from the same materials. Further, the top and bottom sheets, and the pad, can be any shape. As illustrated, the sheets and pad, as well as the product, are rectangular in shape. The product has a leading edge 33, a trailing edge 35, and opposed side edges 37. The pad has a leading edge 39, a trailing edge 41, and opposed side edges 43. The pad leading edge 39 is spaced from the product leading edge 33 by a distance X. The pad trailing edge 41 is spaced from the product trailing edge 35 by a distance X1. The pad side edges 43 are spaced from the respective product side edges 37 by a distance X2. The distances X, X1, and X2 may, but need not, be equal. The top and bottom sheets are sealed to each other along the margins of the respective leading, trailing, and side edges, as is represented by lines 45. Thus, the product 3 consists of the pad captured between the top and bottom sheets.

Multi-web Processing Machine

To manufacture the three-component products 3, the carrier web 13 consists of a top web 47 and a bottom web 49. As will be explained in detail shortly, the multi-web processing machine 1 processes the top web 47 into the product top sheet 27, the bottom web 49 into the product bottom sheet 29, and the infeed web 5 into the product pads 31. For that purpose, the multi-web processing machine draws the top web from a supply roll 51, the bottom web from a supply roll 53, and the infeed web from a supply roll 55. The drive station 23 draws the top and bottom webs in the downstream direction 19 at equal and continuous speeds. The drive station includes a force mechanism 57 that is adjustable to suit the particular web materials.

The infeed web 5 is drawn intermittently from the supply roll 55 to the slip cutting system 7, as is described at length in our previously mentioned U.S. patent application Ser. No. 09/875,525. If desired, multiple infeed webs can be drawn from respective supply rolls simultaneously for traveling in parallel paths alongside each other in the downstream direction 19. In that situation, the top and bottom webs 47 and 49, respectively, are wider than the total transverse distance between the infeed webs.

The slip cutting station 9 of the slip cutting system 7 includes a cutting die 10 and an anvil roller 12 that cooperate to form a nip that defines a plane 103 parallel to the downstream direction 19. The infeed webs 5 are sheeted simultaneously into respective discrete articles 11 at the nip between the cutting die 10 and the anvil roller 12. The discrete articles 11 are inserted with proper alignment and spacing between the top and bottom webs 47 and 49, respectively, at the slip cutting system insert station 15. Thus, the composite web 17 leaving the slip cutting system insert station consists of the top and bottom webs and the discrete articles held between them. The articles are only loosely held in place by friction between them and the webs.

Heating Sealing System

In accordance with the present invention, the heat sealing system 21 both maintains the proper alignment and spacing of the discrete articles 11 between the top and bottom webs 47 and 49, respectively, and also seals the webs to each other to capture the articles between them. For that purpose, the heat sealing system includes a tensioning station 59 and a sealing station 61.

Figure 4:
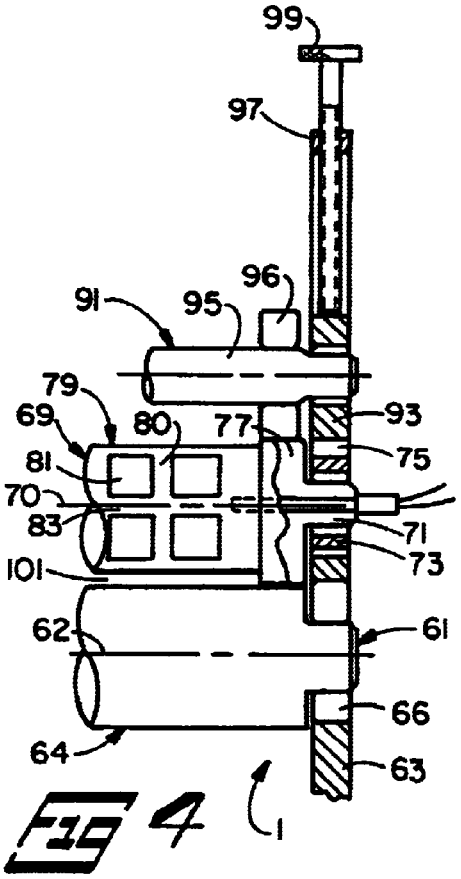
FIG. 4 is a partial cross-sectional view taken along line 4—4 of FIG. 1.
Figure 6:
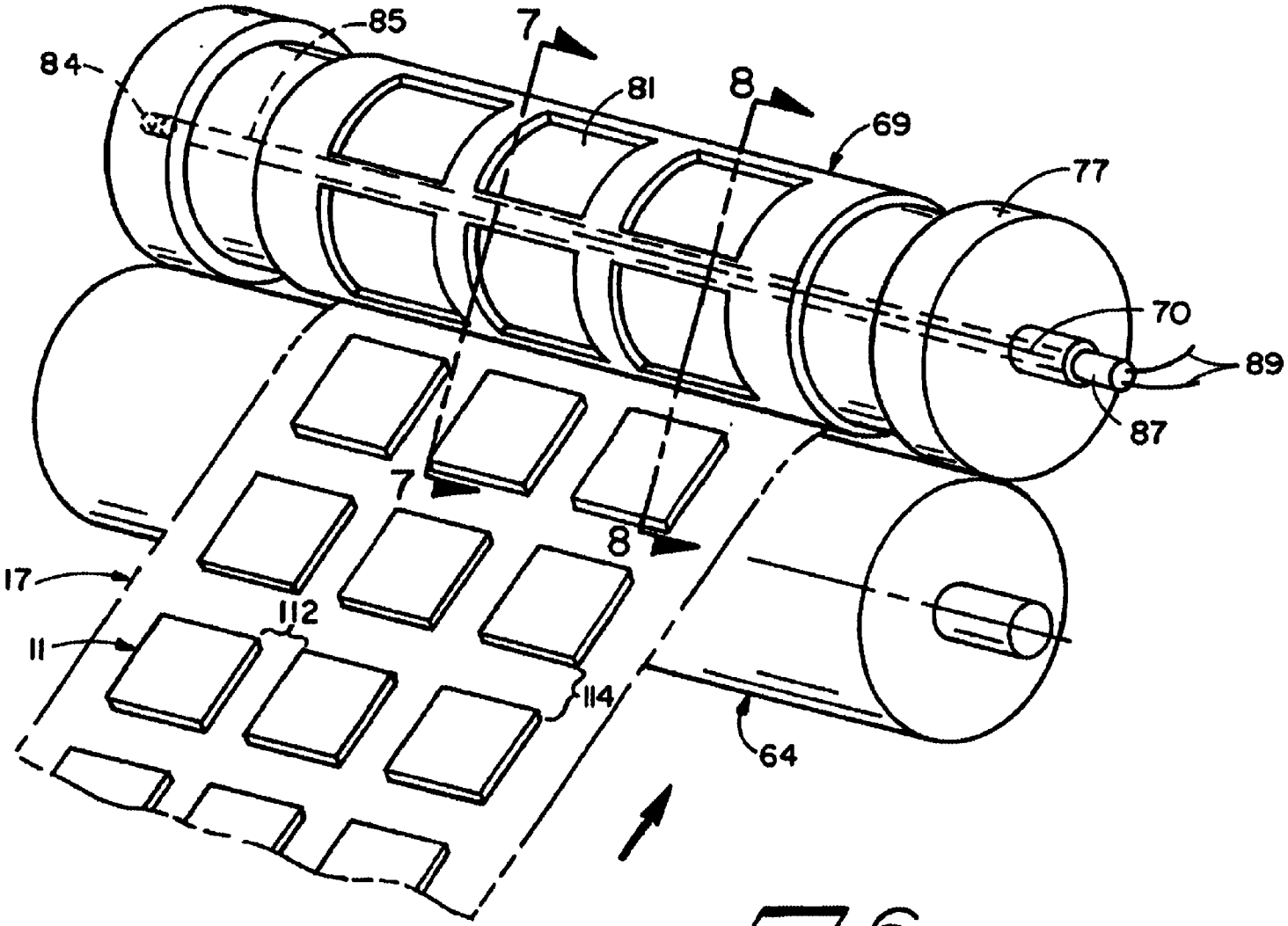
FIG. 6 is a perspective view of the heating die and anvil of the present invention.

Considering the sealing station 61 first, and also looking at FIGS. 4 and 6, the sealing station comprises a uniformly cylindrical anvil 64 having an axis of rotation 62. The anvil 64 is rotatably mounted in fixed bearings 66 in transversely spaced side plates 63 that are part of the multi-web processing machine 1.

The sealing station 61 also comprises a cylindrical heating die 69 having an axial centerline 70 and a journal 71 on each end. The journals 71 are received for rotation in respective die blocks 73. In turn, the die blocks 73 fit and slide within respective slots 75 in the machine side plates 63. The slots 75 are oriented in directions perpendicular to the anvil axis of rotation 62. Thus, the center distance between the heating die and the anvil is variable. The heating die has a cylindrical rail 77 near each journal. Between the rails 77 is a heat sealing grid 79. The heat sealing grid 79 is composed of at least two circumferential lands and at least one transverse land, with a pocket between the lands. In the particular heat sealing grid 79 illustrated, there are four circumferential lands 80 and four transverse lands 83. The lands 80 and 83 are arranged into a pattern that defines 12 rectangular pockets 81. It will be appreciated, of course, that more or fewer pockets can be incorporated into the heating die. Further, the pockets need not be rectangular in shape. The pockets 81 have a depth that is slightly greater than the thickness of the infeed web 5. The diameter of the heat sealing grid lands is slightly less than the diameter of the rails 77.

A deep hole 84 is drilled in the heating die 69 along its axial centerline 70. A long heating element 85 is inserted into the heating die hole 84. The heating element 85 is connected via a rotary connector 87 and wires 89 to a source of electrical power. Energizing the heating element causes it to heat the entire heating die.

The rails 77 of the heating die 69 are kept in contact with the anvil 64 by a force mechanism 91. In the illustrated construction, the force mechanism 91 includes a bearing block 93 in each slot 75 of the machine side plates 63. A bearing bar 95 extends between the bearing blocks 93. The bearing bar 95 holds a bearing 96 close to each bearing block. The bearings 96 contact the heating die rails.

Spanning the open end of each side plate slot 75 is a pressure plate 97. A screw 99 is turned through each pressure plate 97. The ends of the screws 99 bear against the associated bearing blocks 93. Turning the screws applies a linear force between the heating die rails 77 and the anvil 64.

When the heating die rails 77 are in contact with the anvil 64, a clearance 101 exists between the heating die heat sealing grid 79 and the anvil. The amount of the clearance 101 is typically equal to approximately the combined thicknesses of the top and bottom webs 47 and 49, respectively. The heat sealing grid 69 and the anvil thus cooperate to form a nip having the clearance 101. In the particular multi-web processing machine 1 described, the nip lies in a horizontal plane 103 that is parallel to the downstream direction 19.

Figure 7:
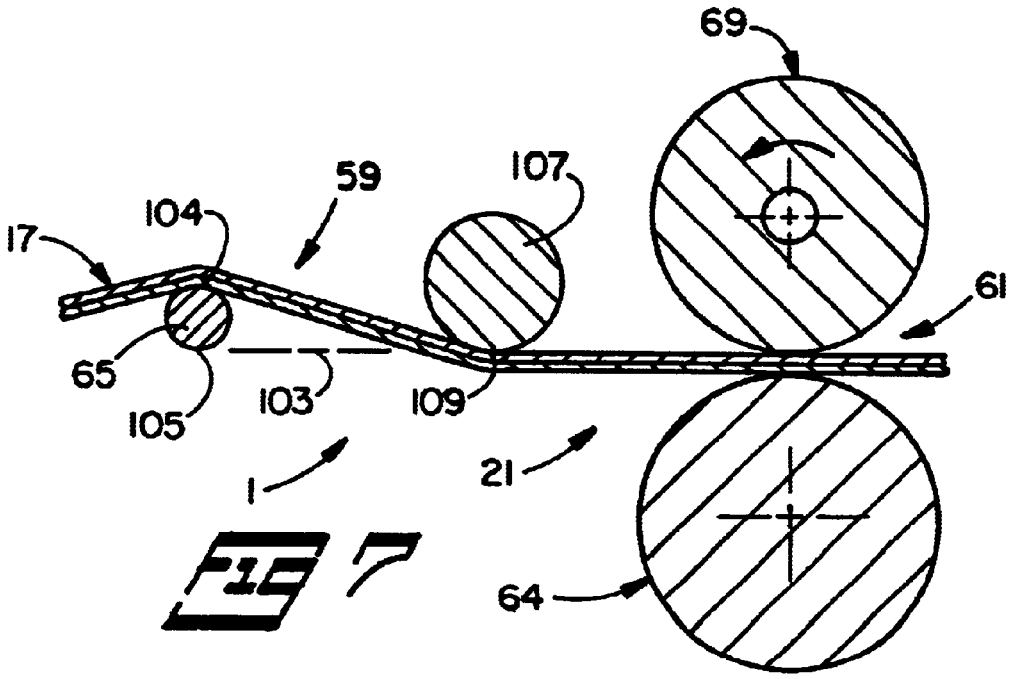
FIG. 7 is a cross-sectional view taken along line 7—7 of FIG. 6 and also showing the tensioning station of the invention.
Figure 8:
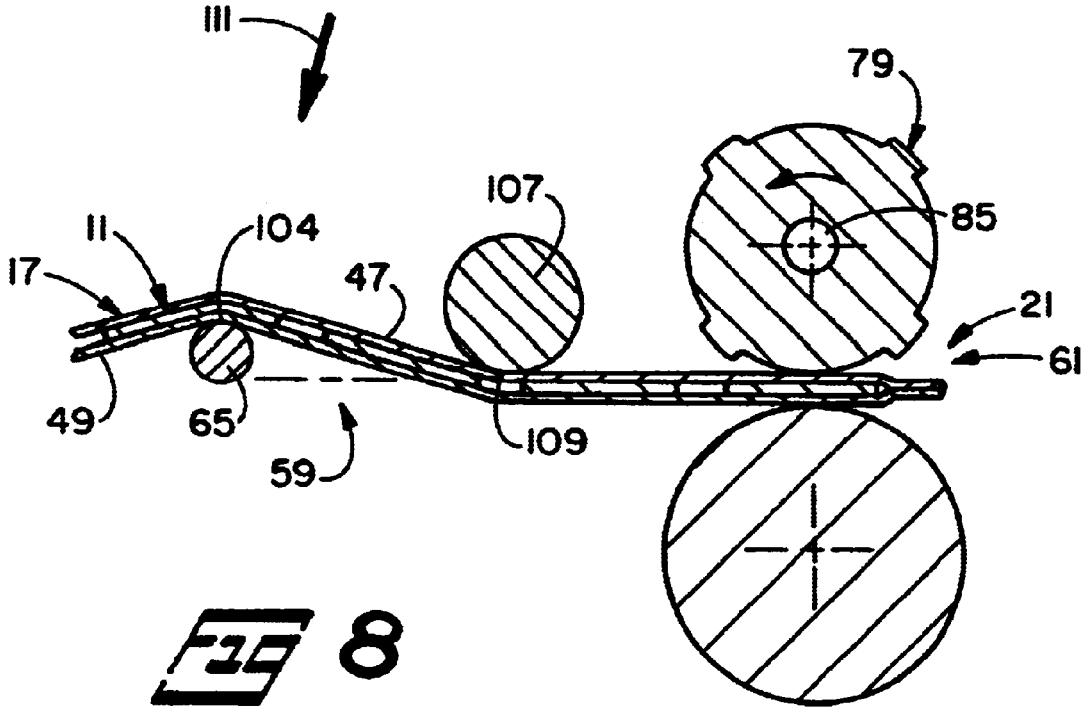
FIG. 8 is a cross-sectional view taken along line 8—8 of FIG. 6 and also showing the tensioning station.

The tensioning station 59 of the heat sealing system 21 is between the sealing station 61 and the slip cutting system 7. The function of the tensioning station is to maintain the articles 11 firmly and accurately in the same alignment and spacing with which they are inserted between the top and bottom webs 47 and 49, respectively, at the insert station 15. In the preferred embodiment, the tensioning station comprises a guide rod 65 mounted between the machine plates 63. It is an important aspect of the invention that the guide rod 65 of the sealing system tensioning station is a common part with the insert station of the slip cutting system 7. The guide rod has a diameter that is relatively small, such as approximately 0.38 inches. It can be adjusted in directions both parallel to and perpendicular to the downstream direction 19. As best seen in FIGS. 7 and 8, the guide rod has an axially extending topmost line 104 and an axially extending lowermost line 105. In the preferred embodiment, the guide rod lowermost line 105 lies in the plane 103 of the nip between the heating die 69 and the anvil 64.

The tensioning station 59 of the rotary heat sealing system 21 also includes a wrap roller 107 that rotates in fixed bearings in the machine side plates 63. The diameter of the wrap roller 107 is substantially larger than that of the guide rod 65; a diameter of approximately 2.00 inches for the wrap roller is satisfactory. The wrap roller has an axially extending bottommost line 109 that lies substantially in the plane 103.

Operation

In the particular multi-web processing machine 1, three infeed webs 5, the top web 47, and the bottom web 49 are processed into the completed products 3. At the slip cutting system 7, the infeed webs are sheeted simultaneously into three parallel columns of the discrete articles 11, and the articles are inserted between the continuously moving top and bottom webs. The articles are initially accurately aligned and spaced relative to both each other and to the top and bottom webs. However, the articles are initially held only loosely in place by friction between them and the top and bottom webs.

The composite web 17 of the articles 11 and the webs 47 and 49 pass over the topmost line 104 of the guide rod 65, and then under the bottommost line 109 of the wrap roller 107. Because of their placements relative to the sealing station 61, the guide rod and wrap roller cooperate to wrap the composite web in a reverse bend between the slip cutting system insert station 15 and the sealing station. The reverse bend creates a tension on the webs and articles. The tension increases the friction between the webs and the articles such that the articles remain at the same alignment and spacing relative to each other and to the webs that they had at the insert station 15. The unequal diameters of the guide rod and the wrap roller enhance the tension produced by them.

An important feature of the invention is that the composite web 17 is fully visible between the insert station 15 and the wrap roller 107. A person can easily observe the composite web by viewing it generally in the direction of arrow 111 to assure that the articles 11 stay properly aligned and spaced as they pass through the tensioning station 59. If a misalignment should occur, an adjustment of the guide rod 65 usually solves the problem without difficulty.

Figure 5:
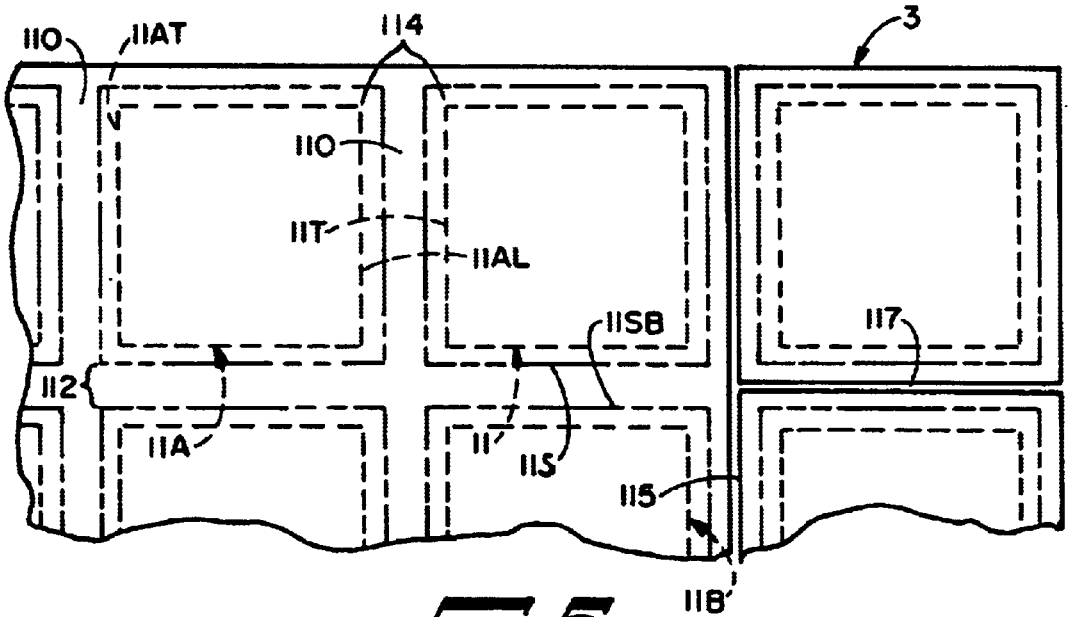
FIG. 5 is a top view of the composite web and products cut from it.

From the rotary heat sealing system tensioning station 59, the composite web 17 enters the sealing station 61. As best shown in FIG. 6, the articles are spaced longitudinally and transversely from each other, with transverse gaps 112 and longitudinal gaps 114 between them. The entire top and bottom webs 47 and 49, respectively, pass between all areas of the heating die heat sealing grid 79 and the anvil 64. Because of the clearance 101 between the heat sealing grid lands 80 and 83 and the anvil, there is little if any compression of the webs within the nip between the heat sealing grid and the anvil. See FIG. 7. The discrete articles 11 are aligned and spaced such that, together with the adjacent areas of the top and bottom webs, they enter the pockets 81 in the heating die, FIG. 8. The warm temperature of the heating die as produced by the heating element 85 seals the two webs to each other at the areas of the webs that correspond to the heat sealing grid 79. When the sealed web leaves the sealing station, the articles are firmly captured in the unsealed areas, FIG. 5. Specifically, the top and bottom webs are sealed to each other around the articles 11 along areas 110, which correspond to the heating die heat sealing grid.

After passing through the drive station 23, the composite web 17 reaches the cutting station 25. There known rotary cutting dies 113 and stationary knives, not shown, cut the composite web through the sealed areas 110. Cutting occurs transversely along lines 115 and longitudinally along lines 117. Each transverse line 115 is in the middle of the longitudinal gap 114 between the trailing edge 11T of a first article 11 and the leading edge 11AL of the next subsequent article 11A. Each longitudinal line 117 is in the middle of the gap 112 between the side edges 11S arid 11SB of a first article 11 and a transversely adjacent article 11B, respectively. The result is the manufacture of the products 3 on a continuous basis. Referring again to FIGS. 2 and 3, it will be recognized that the product top sheet 27 is made from the top web 47, the product bottom sheet 29 is made from the bottom web 49, and the product pad 31 is the article 11.

The force mechanism 91 renders the rotary heat sealing system 21 exceptionally versatile. Different materials for the infeed web 5, as well as different thicknesses of the same material, may require different clearances 101, heat sealing grids 79, or pockets 81. Different heating dies 69 with the required heat sealing grids and pockets are easily interchangeable by removing the pressure plates 97 and bearing blocks 93 with the bearing bar 95 from the machine side plates 63. The die blocks 73 of a previously used heating die 69 are then removed from the side plates. A new heating die is journaled in the die blocks and replaced in the machine 1. In that manner, heating die changeover to suit particular infeed, top, or bottom webs is quickly and easily achieved without requiring any changes to the anvil 64, bearing bar, or bearing blocks.

In summary, the results and advantages of flexible composite products can now be more fully realized. The rotary heat sealing system 21 provides both the ability to maintain a desired alignment and spacing of discrete articles 11 between two continuously moving webs 47 and 49 as well as to seal the webs to each other around the articles. This desirable result comes from using the combined functions of the heating die rails 77 and the heat sealing grid 79. The rails contact the anvil 64 under the action of the force mechanism 91, but the smaller diameter of the heat sealing grid provides a clearance 101 between it and the anvil. The heating die 69 seals the top and bottom webs to each other at areas corresponding to the heat sealing grid around the articles 11, which enter the pockets 81. The tensioning station 59 produces longitudinal tension in the webs and articles by wrapping them in a reverse bend around the guide rod 65 and the wrap roller 107. A person is able to observe the alignment and spacings of the articles as the composite web 17 enters the sealing station 61. The guide rod is adjustable to suit both different product materials and to correct any misalignment of the articles between the webs.

It will also be recognized that in addition to the superior performance of the present invention, its construction is such as to cost little, if any, more than traditional web processing machines. Also, because the heating die 69 and anvil 64 operate in a rotary manner, they produce no vibrations even while operating on a continuous basis. Consequently, the need for maintenance is reduced.

Thus, it is apparent that there has been provided, in accordance with the invention, a rotary heat sealing system that fully satisfies the aims and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

We claim:

1. A method of manufacturing a product comprising the steps of:

a. drawing top and bottom webs continuously in a downstream direction;

b. inserting flexible articles at predetermined alignments and spacings between the top and bottom webs at an insert station;

c. passing the top and bottom webs and the articles through a tension station located in the downstream direction from the insert station and producing a tension on the top and bottom webs and the articles so as to maintain the articles at the predetermined alignments and spacings;

d. passing the top and bottom webs through a nip between an anvil and a heat sealing grid of a heating die located in the downstream direction of the tension station, and entering the articles into pockets in the heating die; and e. sealing the top and bottom webs to each other at areas thereon corresponding to the heat sealing grid of the heating die.

2. The method of claim 1 wherein:

a. the step of passing the top and bottom webs through a nip comprises the step of defining a nip plane between the anvil and heat sealing grid of the heating die; and b. the step of producing a tension comprises the steps of:

i. providing a guide rod having a first axially extending line at a first distance from the nip plane and a second axially extending line opposite the first axially extending line;

ii. providing a wrap roller having a first axially extending line at a second distance less than the first distance from the nip plane, the guide rod first axially extending line being spaced farther from the nip plane than the wrap roller first axially extending line; and iii. contacting the top and bottom webs and the articles with the guide rod first axially extending line and with the wrap roller first axially extending line and thereby wrapping the top and bottom webs and the articles in a reverse bend prior to passing the top and bottom webs through the nip.

3. The method of claim 1 comprising the further step of cutting the sealed top and bottom webs in the downstream direction and in a direction transverse to the downstream direction around each article and thereby producing individual products each consisting of only one article and selected portions of the top and bottoms webs.

4. The method of claim 1 wherein the step of passing the top and bottom webs through a nip between the anvil and the heat sealing grid of a heating die and entering the articles into pockets of a heating die comprises the steps of:

a. providing the heating die with spaced apart circumferential rails of a first predetermined diameter;

b. locating the heat sealing grid between the circumferential rails;

c. providing the heat sealing grid with at least two circumferential lands and at least one transverse land each having a diameter less than the first diameter and said at least one transverse land connecting the circumferential lands; and d. entering the articles into pockets defined by the heat sealing grid circumferential and transverse lands.

5. The method of claim 4 wherein the steps of passing the top and bottom webs through the nip between the anvil and the heat sealing grid of the heating die comprises the step of contacting the circumferential rails of the heating die with the anvil and avoiding passing the top and bottom webs between the circumferential rails of the heating die and the anvil.

6. A method of manufacturing a product comprising the steps of:

a. providing an anvil and a heat sealing die having a sealing grid that cooperates with the anvil to define a nip and a nip plane;

b. providing a wrap roller in an upstream direction of the nip and having a first axially extending line at a first distance from the nip plane;

c. providing a guide rod in the upstream direction of the wrap roller and having a first axially extending line at a second distance greater than the first distance from the nip plane and a second axially extending line opposite the first axially extending line;

d. contacting the guide rod first axially extending line and the wrap roller first axially extending line with top and bottom webs and articles therebetween and drawing the top and bottom webs and the articles in a reverse bend over the guide rod and wrap roller;

e. drawing the top and bottom webs and the articles through the nip between the anvil and the heating die, and entering the articles into respective pockets of a heat sealing grid in the heating die; and f. sealing the top and bottom webs to each other at areas corresponding to the heat sealing grid of the heating die.

7. The method of claim 6 wherein:

a. the step of drawing the top and bottom webs through the nip comprises the step of drawing the top and bottom webs through the nip along the nip plane;

b. the step of providing a wrap roller comprises the step of locating the wrap roller first axially extending line generally in the nip plane; and c. the step of providing a guide rod comprises the step of locating the guide rod first axially extending line generally in the nip plane.

8. The method of claim 7 wherein:

a. the step of providing a wrap roller comprises the step of providing a wrap roller having a first diameter; and b. the step of providing a guide rod comprises the step of providing a guide rod having a second diameter less than the first diameter.

9. A method of manufacturing a product comprising the steps of:

a. providing a heating die having spaced apart circumferential rails of a first diameter, and a heat sealing grid of a second diameter between the circumferential rails;

b. contacting an anvil with the heating die circumferential rails, and providing a nip that defines a nip plane between the anvil and the heating die heat sealing grid;

c. drawing top and bottom webs continuously in a downstream direction;

d. locating an insert station in an upstream direction of the heating die and anvil;

e. inserting flexible articles in a predetermined alignment and spacing between the top and bottom webs at the insert station;

f. passing the top and bottom webs and the articles through the nip between the heating die heat sealing grid and the anvil and avoiding passing the top and bottom webs between the heating die heat circumferential rails and the anvil; and g. sealing the top and bottom webs to each other at areas thereon corresponding to the heat sealing grid of the heating die.

10. The method of claim 9 comprising the further step of cutting the sealed top and bottom webs in the downstream direction and in a direction transverse to the downstream direction around each article and thereby producing individual products each consisting of only one article and selected portions of the top and bottom webs.

11. The method of claim 9 comprising the further step of producing a tension in the top and bottom webs and the articles at a location between the insert station and the nip between the heating die heat sealing grid and the anvil.

12. The method of claim 9 comprising the further steps of:

a. providing a guide rod between the insert station and the nip, and locating a first axially extending line on the guide rod at a first distance from the nip plane and locating a second axially extending line on the guide rod opposite the first axially extending line;

b. providing a wrap roller between the guide rod and the nip, and locating a first axially extending line on the wrap roller at a second distance less than the first distance from the nip plane; and c. contacting the top and bottom webs and the articles with the guide rod first axially extending line and with the wrap roller first axially extending line and thereby wrapping the top and bottom webs and the articles in a reverse bend prior to passing the top and bottom webs through the nip.

* * * * *